US008689519B2

(12) United States Patent
Zelich

(10) Patent No.: US 8,689,519 B2
(45) Date of Patent: Apr. 8, 2014

(54) MULTI-HOLE CONCEALER STRIP

(76) Inventor: Jason Zelich, Chandler, AZ (US)

( * ) Notice: Subject to any disclaimer, the term of this patent is extended or adjusted under 35 U.S.C. 154(b) by 0 days.

(21) Appl. No.: 13/507,947

(22) Filed: Aug. 9, 2012

(65) Prior Publication Data

US 2014/0042880 A1 Feb. 13, 2014

(51) Int. Cl.
*E04C 2/38* (2006.01)

(52) U.S. Cl.
USPC ..... 52/718.04; 52/716.6; 52/718.01; 248/231.9; 248/235

(58) Field of Classification Search
USPC ..... 52/718.04, 716.1, 716.6, 718.01, 52/717.03; 248/231.9, 235, 345.1
See application file for complete search history.

(56) References Cited

U.S. PATENT DOCUMENTS 2,665,183 A * 1/1954 Battles ..... 52/782.23
4,123,129 A * 10/1978 Butler ..... 312/265.3
4,731,960 A * 3/1988 Sease ..... 52/36.6
5,829,864 A * 11/1998 Scanlan ..... 362/133
6,354,049 B1 * 3/2002 Bennett ..... 52/287.1
6,378,255 B1 * 4/2002 Eich et al. ..... 52/220.7
6,502,706 B1 * 1/2003 Kent ..... 211/87.01
6,536,173 B2 * 3/2003 Rebman ..... 52/465
6,581,788 B1 * 6/2003 Winig et al. ..... 211/90.01
7,392,589 B2 * 7/2008 Friegang ..... 33/42
7,793,483 B2 * 9/2010 Stanchfield et al. ..... 52/716.1
7,950,199 B2 * 5/2011 Newhouse et al. ..... 52/741.4
7,958,691 B1 * 6/2011 Newhouse et al. ..... 52/717.01
8,434,835 B2 * 5/2013 Hardy et al. ..... 312/245
2002/0043041 A1 * 4/2002 Yoyasu ..... 52/716.5
2002/0178684 A1 * 12/2002 Barnett ..... 52/716.1
2010/0155354 A1 * 6/2010 Krueger et al. ..... 211/183
2012/0111818 A1 * 5/2012 Kitt et al. ..... 211/134
2012/0298822 A1 * 11/2012 Wilbs ..... 248/250
2013/0160483 A1 * 6/2013 Hasturk et al. ..... 62/452

* cited by examiner

*Primary Examiner* — Bradley Duckworth

(57) ABSTRACT

The Multi-Hole Concealer Strip conceals any exposed holes in cabinetry designs. It is a decorative strip that accents any cabinet with a smooth appearance to leave a finished look to the cabinetry.

2 Claims, 6 Drawing Sheets

MULTI-HOLE CONCEALER STRIP

BACKGROUND OF THE INVENTION (1) Field of the Invention

The invention solves a problem with exposed holes in cabinets for office, closet, and kitchens. With mass manufacturing so prevalent today this invention conceals the holes with a decorative design.

(2) Description of the Art Including Information Disclosed Under 37 CFR 1.97 & 1.98

The art described in the drawings of the design have no prior art to our findings and the invention is unique in its design and use.

BRIEF SUMMARY OF THE INVENTION

The present invention provides among other things a multi-hole concealer strip. The multi-hole concealer strip may comprise a strip, a plurality of fasteners, and a shelf brace, wherein the shelf brace may be configured to be attached to the strip and wherein the strip further comprises a track configured to be attached to a plurality of fasteners or shelf brace. The fasteners may further comprise a base configured to be attached to the strip and a peg configured to be attached to the base, wherein the peg may be configured to be attached to a hole. The shelf brace may further comprise a substantially flat surface configured to be attached to a shelf, wherein the substantially flat surface may support the shelf; a peg which may be configured to be attached to a hole; and a protruding member, wherein the protruding member may be configured to be attached to the strip.

BRIEF DESCRIPTION OF THE SEVERAL VIEWS OF THE DRAWINGS

There are 8 drawings in total that describe and illustrate the design of the "Multi-Hole Concealer Strip".

DETAILED DESCRIPTION OF THE PREFERRED EMBODIMENT

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Modern furniture such as cabinets and entertainment centers is often manufactured with a pre-drilled set of holes along the interior walls of the product. These pre-drilled holes are designed to allow various shelving configurations. For example, certain glasses may require more space between the shelves compared to plates. In exchange for this flexibility in shelving configurations, the other un-used pre-drilled holes are left exposed, creating a less than optimal viewing experience. In one embodiment of the invention, a multi-hole concealer strip is disclosed which may be configured to be attached to the set of pre-drilled holes and conceal them from view.

Figure 1:
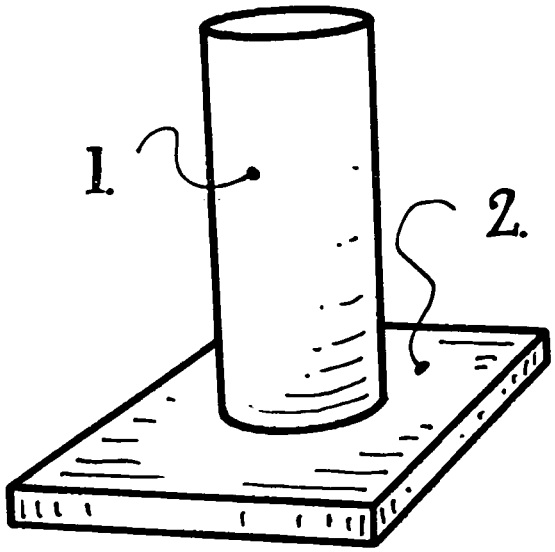
FIG. 1: is the side view of the fasteners that fits into the pre-fabricated holes
Figure 2:
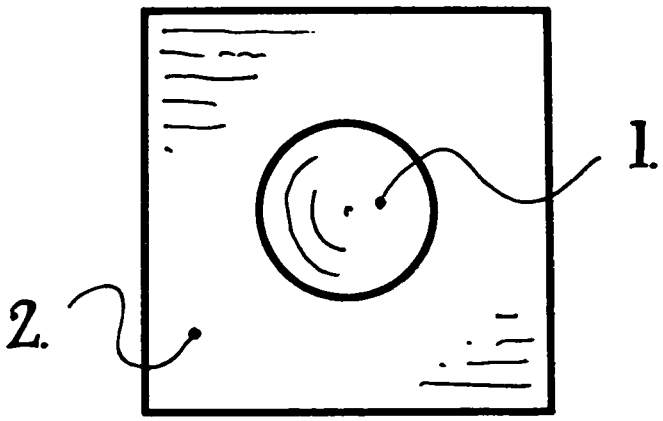
FIG. 2: is the bottom of the fasteners that fits into the holes itself
Figure 3:
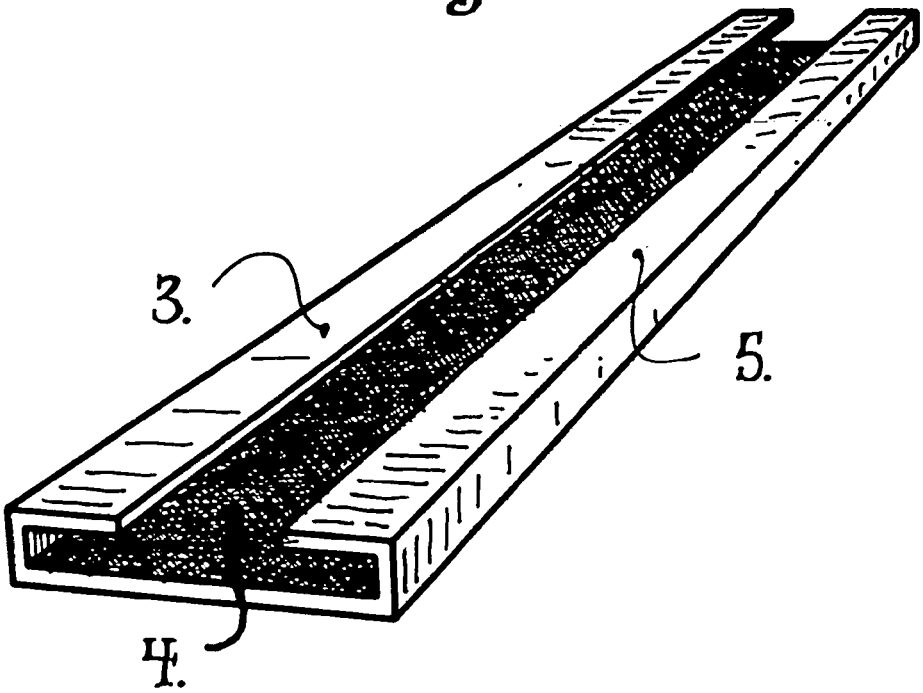
FIG. 3: is the overall angle view of the square concealer strip with the channel exposed on the underside
Figure 4:
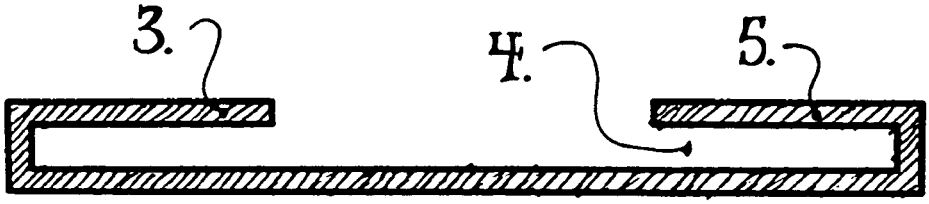
FIG. 4: is the side view of the channel design of the square concealer strip
Figure 5:
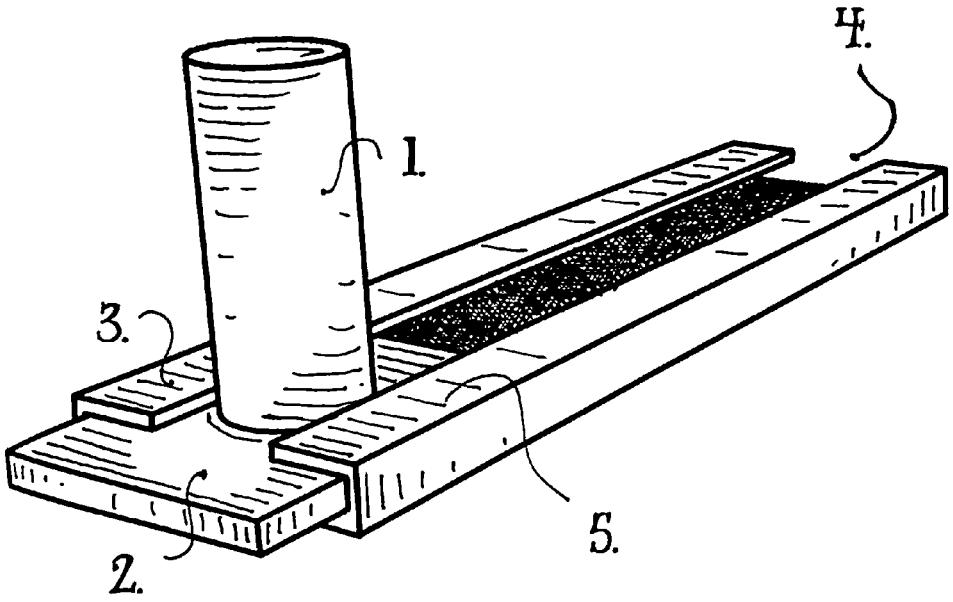
FIG. 5: is the angle view of the fasteners fitting inside the track of the square concealer strip
Figure 6:
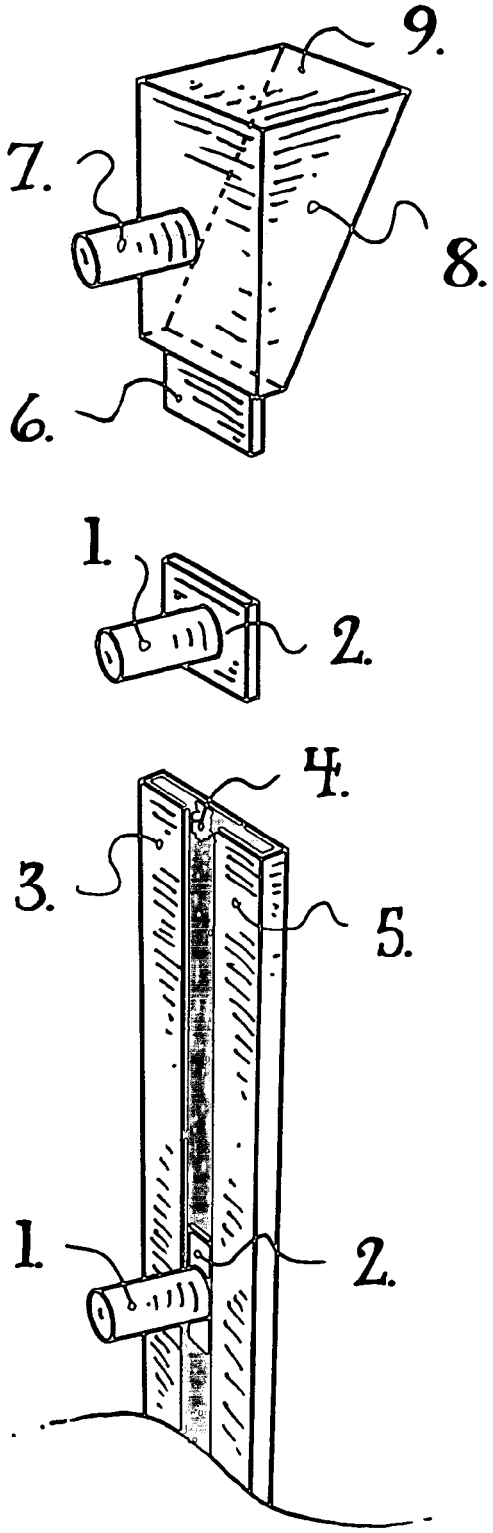
FIG. 6: is the angle view of the square concealer strip sliding onto the shelf support
Figure 8:
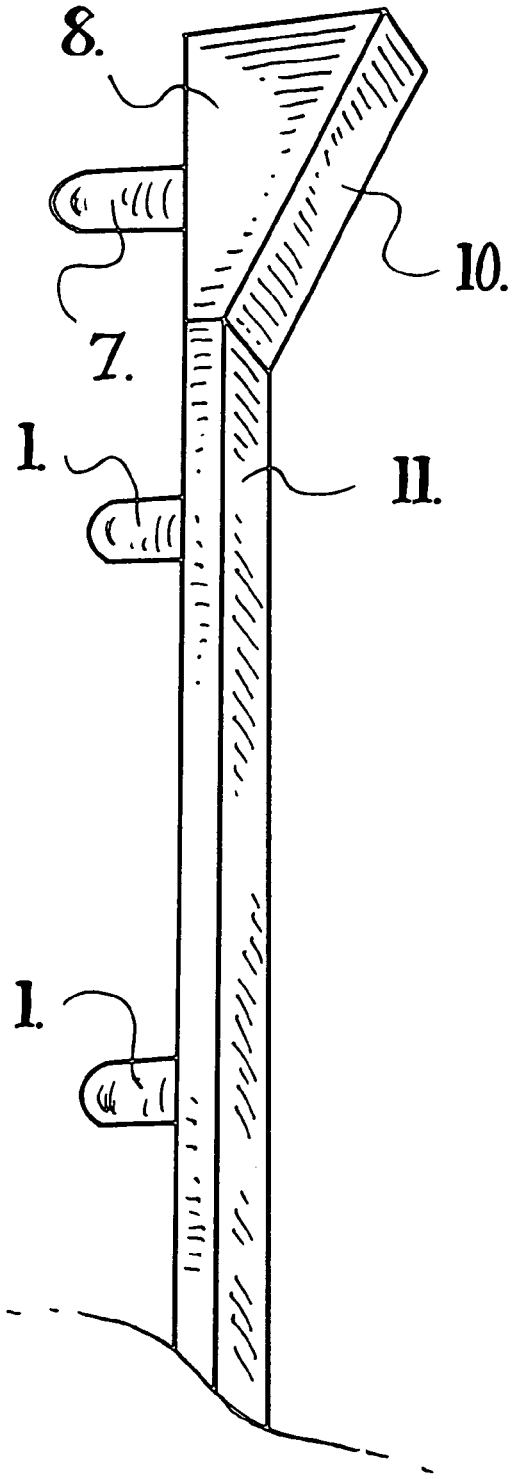
FIG. 8: is a three-quarter view of the apparatus fully assembled

In one embodiment of the invention, the multi-hole concealer strip may be implemented as depicted in FIG. 8. The multi-hole concealer strip may comprise a strip 11, a plurality of fasteners 1, and a shelf brace component 10. The strip may further comprise a track 4 as depicted in FIG. 5, wherein the track 4 may be configured to fit a plurality of fasteners as depicted in FIG. 1 and/or shelf brace as depicted in FIG. 6. In one embodiment of the invention, the strip 11 may made of a light-weight and flexible material such as a flexible plastic or rubber. The track 4 of the strip may be configured to fit a plurality of fasteners. One skilled in the art will understand that the plurality of the fasteners may be moved along the track of the strip. This allows the fastener to fit into various holes of various distances apart as depicted in FIG. 6.

Each fastener may be implemented as depicted in FIG. 1. The fastener may comprise a base 2 configured to be attached to the strip and a peg 1 which may be configured to be attached to the base, wherein the peg is configured to be attached to a hole. In one embodiment of the invention, the base is a substantially square shaped; however, one skilled in the art may use any shape that may be configured to fit within the track of the strip. For example, the base may be circular, rectangular, or any other shape which allows the base 2 to slide along the track 4 as depicted in FIG. 5. In one embodiment of the invention, the peg 1 is tubular shaped and the tip of the peg is substantially circular; however, one skilled in the art may use any shape for the peg that would allow it to be attached to the base as well as configured to be attached to fit within a hole. For example, the peg may be rectangular shaped as long as the peg is configured to fit within a hole.

Figure 7:
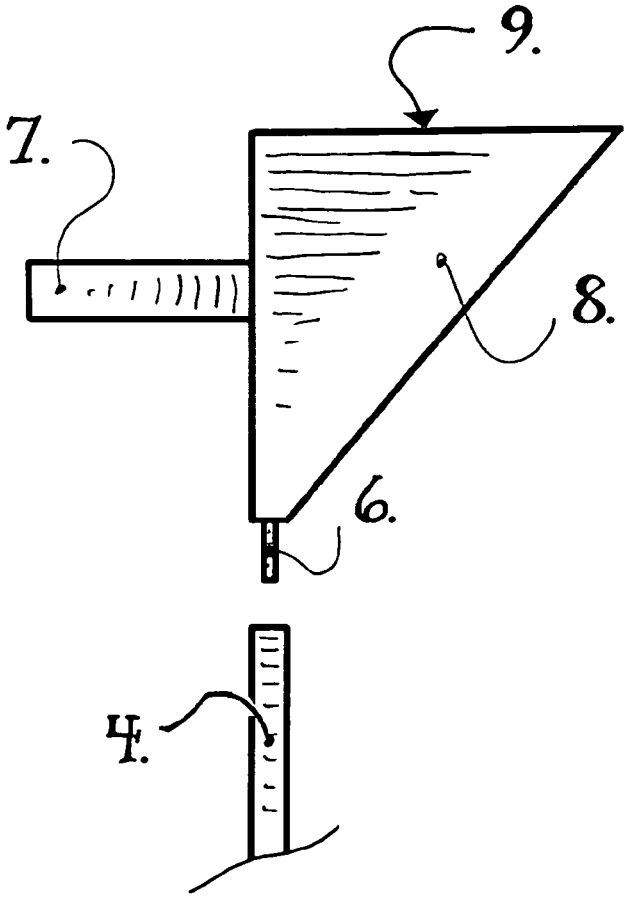
FIG. 7: is the side view of the shelf support with the fasteners attached with the attached member to be inserted and attached to the concealer strip

In one embodiment of the invention, the shelf brace 8 may be implemented as depicted in FIG. 7. The shelf brace may comprise a substantially flat surface 9 which is configured to be attached to a shelf, wherein the substantially flat surface may support the shelf. The shelf brace may also comprise a peg 7, wherein the peg 7 is configured to be attached to a hole. The shelf brace may also comprise a protruding member 6, wherein the protruding member 6 may be configured to be attached to the strip 11. The protruding member 6 of the shelf brace may be configured to be attached to the track of the strip 4. For example, the protruding member may slide into the track or clip onto the strip. The peg 7 of the shelf brace operates the same way as the peg of the fastener. One skilled in the art will know that the peg is configured to be attached to a hole. Once attached to a hole, the substantially flat portion of the shelf brace may be configured to support the bottom portion of a shelf.

DETAILED DESCRIPTION OF THE INVENTION

The "Multi-Hole Concealer Strip" is a newly designed invention that will conceal exposed holes in any cabinetry such as kitchen cabinets, closet cabinets, office cabinets, and any other type of cabinetry. It fits into the holes and can adjust to any size and can come in many different colors and materials and in many different styles as to the decorative affect to the cabinet it is used with. The finished appearance on the exposed side of the invention may be square or round in its shape or may have many different designs on the finished surface to adapt to any request by any consumer.

I claim:

1. A multi-hole concealer strip, comprising:

a strip comprising a channel;

a plurality of fasteners, wherein the fasteners comprise a peg having a shaft and a base, wherein the shaft of the peg is non-threaded and the base is coupled to the strip such that a sliding engagement is formed between the channel of the strip and the fastener; and a shelf brace, wherein the shelf brace comprises a protruding member configured to fit within the channel in sliding engagement.

2. The multi-hole concealer strip of claim 1, wherein the shelf brace further comprises:

a substantially flat surface configured to be attached to a shelf, wherein the substantially flat surface supports the shelf; and a peg configured to be attached to a hole, wherein the peg is non-threaded.

* * * * *